US010373575B2

(12) United States Patent
Park et al.

(10) Patent No.: US 10,373,575 B2
(45) Date of Patent: Aug. 6, 2019

(54) DISPLAY APPARATUS

(71) Applicant: Samsung Display Co., LTD., Yongin, Gyeonggi-Do (KR)

(72) Inventors: Suhyeong Park, Gyeongju-si (KR); Kyoungwon Lee, Seoul (KR); Hoyong Jung, Seongnam-si (KR); Cheolwoo Park, Suwon-si (KR); Bonghyun You, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 649 days.

(21) Appl. No.: 14/755,241

(22) Filed: Jun. 30, 2015

(65) Prior Publication Data

US 2016/0063962 A1 Mar. 3, 2016

(30) Foreign Application Priority Data

Sep. 1, 2014 (KR) ..... 10-2014-0115391

(51) Int. Cl.
*G09G 3/36* (2006.01)

(52) U.S. Cl.
CPC ..... *G09G 3/3611* (2013.01); *G09G 3/3666* (2013.01); *G09G 3/3685* (2013.01); *G09G 3/3696* (2013.01); *G09G 2310/0221* (2013.01); *G09G 2310/0281* (2013.01);
(Continued)

(58) Field of Classification Search
CPC .. G09G 3/3611; G09G 3/3685; G09G 3/3666; G09G 3/3696; G09G 2310/0221; G09G 2310/0281; G09G 2330/021; G09G 2330/022; G09G 2330/02; G09G 2370/08
See application file for complete search history.

(56) References Cited

U.S. PATENT DOCUMENTS

2006/0132417 A1* 6/2006 Shigenobu ..... G09G 3/3696 345/98
2009/0027373 A1* 1/2009 Chiang ..... G09G 3/20 345/212
(Continued)

FOREIGN PATENT DOCUMENTS

KR 1020120059351 A 6/2012
KR 1020120061543 A 6/2012
(Continued)

*Primary Examiner* — William Boddie
*Assistant Examiner* — Saifeldin E Elnafia
(74) *Attorney, Agent, or Firm* — Cantor Colburn LLP

(57) ABSTRACT

A display apparatus includes: a timing control block which outputs image data based on external image data and control signals, and generates data and gate-side control signals based on the external control signal; a source drive block which converts the image data into a data voltage based on the data control signal; a low frequency detection block which detects a low power drive period based on the external control signal and generates a power control signal, a state of which is determined based on a result of the detection; an integrated chip which receives first and second drive voltages and includes a first switch block that turns off a circuit of the source drive block based on the power control signal during the low power drive period; a gate drive circuit which generates a gate signal based on a gate control signal from the integrated chip; and a display panel.

16 Claims, 9 Drawing Sheets

(52) U.S. Cl.
CPC ... *G09G 2330/02* (2013.01); *G09G 2330/021* (2013.01); *G09G 2330/022* (2013.01); *G09G 2370/08* (2013.01)

(56) References Cited

U.S. PATENT DOCUMENTS

| | | | | |
|---|---|---|---|---|
| 2011/0148841 | A1* | 6/2011 | Yeo | G09G 3/3688 345/211 |
| 2011/0199404 | A1 | 8/2011 | Umezaki et al. | |
| 2012/0013587 | A1* | 1/2012 | Yen | G09G 3/3688 345/211 |
| 2012/0169698 | A1* | 7/2012 | Park | G09G 3/20 345/211 |
| 2015/0228216 | A1 | 8/2015 | Lee et al. | |

FOREIGN PATENT DOCUMENTS

| | | | |
|---|---|---|---|
| KR | 1020140076252 | A | 6/2014 |
| KR | 1020150094881 | A | 8/2015 |

* cited by examiner

DISPLAY APPARATUS

This application claims priority to Korean Patent Application No. 10-2014-0115391 filed on Sep. 1, 2014, and all the benefits accruing therefrom under 35 U.S.C. § 119, the content of which in its entirety is herein incorporated by reference.

BACKGROUND

Embodiments of the invention described herein relate to a display apparatus, and more particularly, relate to a display apparatus with reduced power consumption.

A display apparatus typically includes a display panel, and a driver for activating the display panel. Such a driver may generate a control signal for activating the display panel, along with an image signal supplied from an external source. The control signal may be transferred to activate the display panel.

Images expressed on the display panel may be classified into still and motion images. A display panel may display a plurality of frames per second. In such a display panel, if the frames are same each other in image data during such frames, the display panel may display a still image. If the frames are different in image data during such frames, the display panel may display a motion image.

In an operation of the display apparatus, a signal generator consumes a large amount of power in receiving the same image data from a graphic processor not only while the display panel is displaying a motion image, but also while the display panel is displaying a still image.

SUMMARY

Embodiments of the invention are directed to a display apparatus with reduced power consumption.

In an embodiment, a display apparatus may include a timing control block which outputs image data based on external image data in response to external control signals, and generates a data control signal and a gate-side control signal based on the external control signal; a source drive block which converts the image data into a data voltage in response to the data control signal; a low frequency detection block which receives the external control signal, detects a low power drive period based on the external control signal and generates a power control signal, a state of which is determined based on a result of the detection of the low power drive period; an integrated chip which receives first and second drive voltages, where the integrated chip includes a first switch block which turns off a circuit of the source drive block in response to the power control signal from the low frequency detection block during the low power drive period; a gate drive circuit which generates a gate signal in response to a gate control signal from the integrated chip; and a display panel which receives the gate signal and the data voltage and displays an image.

BRIEF DESCRIPTION OF THE FIGURES

The above and other features of the invention will become apparent from the following description with reference to the following figures, in which.

DETAILED DESCRIPTION

Figure 1:
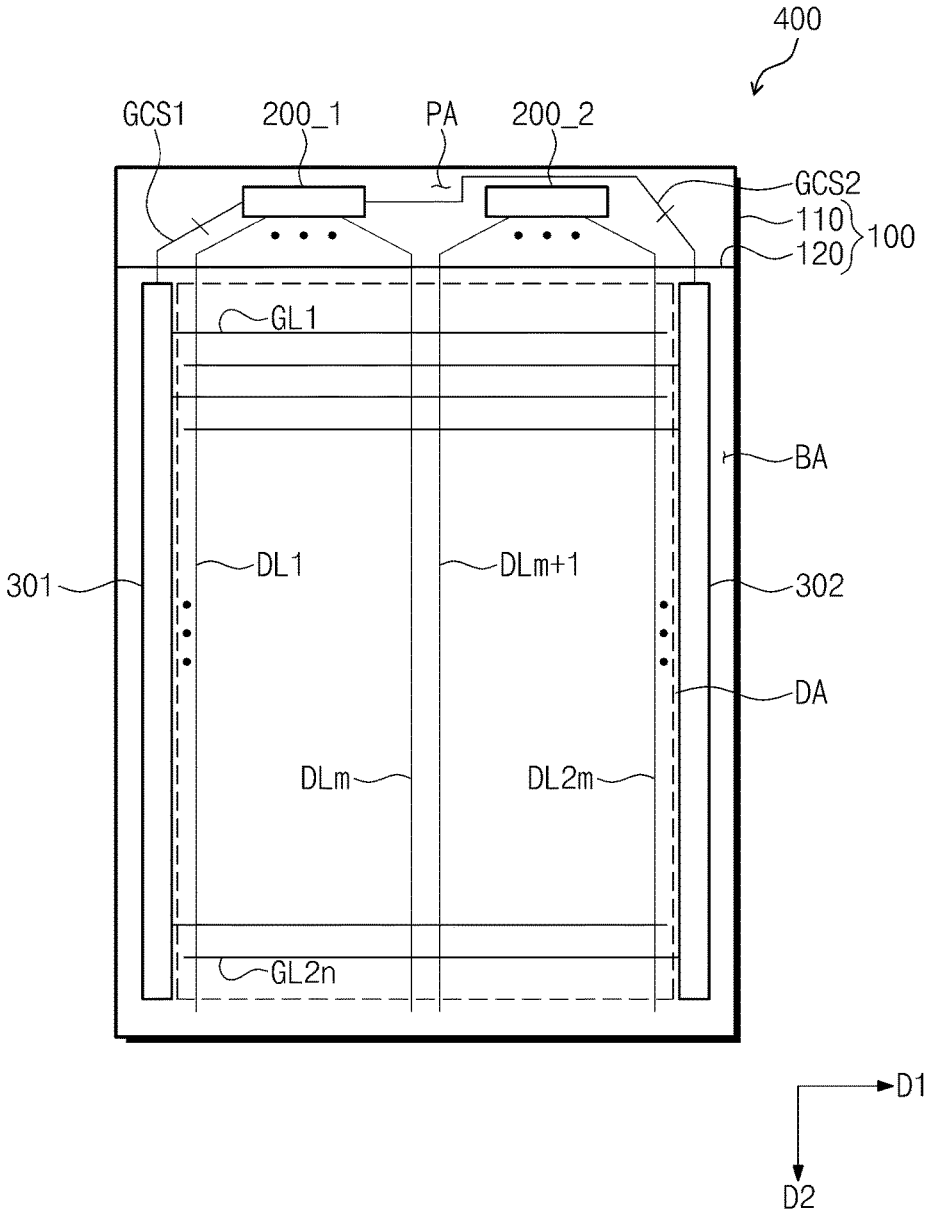
FIG. 1 is a schematic plan view of an exemplary embodiment of a display apparatus according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings herein.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Also, the term "exemplary" is intended to refer to an example or illustration.

It will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiment of the invention will be described in detail with reference to accompanying drawings.

FIG. 1 is a schematic plan view of an exemplary embodiment of a display apparatus according to the invention.

Referring to FIG. 1, an exemplary embodiment of the display apparatus 400 includes a display panel 100, first and second integrated chips 200_1 and 200_2, and first and second gate drive circuits 301 and 302.

The display panel 100 may include a first substrate 110, a second substrate 120 disposed opposite to and coupled to the first substrate 110, and a gray scale control layer (not shown) interposed between the first and second substrates 110 and 120 to control optical transmittance of the display panel 100.

In an exemplary embodiment of the invention, the display panel 100 may be a type of liquid crystal display panel having a liquid crystal layer as the gray scale control layer. In another exemplary embodiment, the display panel 100 may include another type of light-emitting device such as organic electric-field emission device, electrophoresis device or the like.

In an exemplary embodiment, where the display panel 100 includes a liquid crystal display panel, the display panel 100 may further include a backlight unit (not shown) disposed at a backside thereof. The backlight unit may be at the backside of the display panel 100 to supply light to the display panel 100. The backlight unit may include a light emission diode ("LED") or a cold cathode fluorescent lamp ("CCFL") as a light source thereof.

The display panel 100 may be divided into a display area DA where images are displayed, and a black matrix area BA which surrounds the display area DA. The display area DA of the display panel 100 displays an image, and the black matrix area BA of the display panel 100 includes a black matrix provided therein to prevent light leakage.

The display area DA includes a plurality of gate lines GL1 to GL2*n*, a plurality of data lines DL1 to DL2*m*, and a plurality of pixels. Herein, n and m are natural numbers. In such an embodiment, the plural gate lines GL1 to GL2*n* may extend toward a first direction D1 and arranged in a second direction D2 intersecting the first direction D1. The plural data lines DL1 to DL2*m* may extend toward the second direction D2 and arranged in the first direction D1. The gate lines GL1 to GL2*n* and the data lines DL1 to DL2*m* may be disposed in different layers, intersecting each other while electrically isolated from each other.

The gate lines GL1 to GL2*n* and the data lines DL1 to DL2*m* are connected to a plurality of pixel regions defined in the display area DA. A plurality of pixels may be disposed in the pixel regions, respectively. Each pixel may include a thin film transistor and a liquid crystal capacitor. The liquid crystal capacitor includes first and second electrodes, and the liquid crystal layer further include a dielectric material interposed between the first and second electrodes.

In an exemplary embodiment of the invention, the gate lines GL1 to GL2*n*, the data lines DL1 to DL2*m*, the thin film transistors of the pixels, and pixel electrodes that are first electrodes of the liquid crystal capacitors may be disposed in the first substrate 110. A reference electrode as the second electrode of the liquid crystal capacitor may be disposed in the second substrate 120.

The first substrate 110 includes the pixel electrodes. Each pixel electrode is arranged in a corresponding pixel of the pixels. Each pixel electrode receives a data voltage through the thin film transistor corresponding thereto. In the second substrate 120, the reference electrode may be in the form of a single unitary electrode and disposed opposite to the pixel electrodes. The reference electrode may be applied with a reference voltage. In such an embodiment, an electric field may be generated between the pixel electrode and the reference electrode by a voltage difference between the data voltage and the reference voltage. The liquid crystal layer controls light transmittance thereof in accordance with the magnitude of the electric field generated between the pixel electrode and the reference electrode.

The first and second gate drive circuits 301 and 302 are disposed in the black matrix area BA. In an exemplary embodiment, as shown in FIG. 1, the first gate drive circuit 301 is disposed adjacent to one ends (e.g., first ends or ends on the left side) of the gate lines GL1 to GL2*n* from the display area DA, and connected to odd-numbered gate lines of the gate lines GL1 to GL2*n*. In such an embodiment, the second gate drive circuit 302 is disposed adjacent to the other end (e.g., second ends or ends on the right side) of the gate lines GL1 to GL2*n* from the display area DA, and connected to even-numbered gate lines of the gate lines GL1 to GL2*n*. In another embodiment, each of the first and second gate drive circuits 301 and 302 may be connected to all of the gate lines GL1 to GL2*n*.

Each of the first and second gate drive circuits 301 and 302 includes a plurality of stages sequentially (e.g., cascadely) connected to each other. In an exemplary embodiment, the number of the stages included in each gate drive circuit may be greater than n (n is a positive integer). In such an embodiment, the number of the stages in each gate drive circuit may be larger than the number of the gate lines connected to each gate drive circuit. Each stage may include a plurality of drive transistors. Each drive transistor may include an amorphous transistor or an oxide semiconductor transistor. In one exemplary embodiment, for example, the drive transistors may be formed directly on the black matrix area BA of the first substrate 101 while processing thin film deposition for fabricating the thin film transistors of the pixels in the first substrate 110.

The display panel 100 further includes a peripheral area PA. The peripheral area PA may be defined by a portion of the first substrate 110 that extends further than the second substrate 120, and may include pads (not shown) for supplying signals to the first substrate 110.

The first and second integrated chips 200_1 and 200_2 are disposed on (e.g., embedded on) the peripheral area PA and electrically connected to the pads. The first integrated chip 200_1 is connected to first to m-th data lines DL1 to DLm of the data lines DL1 to DL2*m* to supply data signals to the first to m-th data lines DL1 to DLm, while the second integrated chip 200_2 is connected to (m+1)-th to 2m-th data lines DLm+1 to DL2*m* of the data lines DL1 to DL2*m* to supply data signals to the (m+1)-th to 2m-th data lines DLm+1 to DL2*m*.

In an exemplary embodiment, one of the first and second integrated chips 200_1 and 200_2 may be connected to the first and second gate drive circuits 301 and 302. In one exemplary embodiment, for example, the first integrated chip 200_1 may be connected to the first and second gate drive circuits 301 and 302 to supply first and second gate control signals GCS1 and GCS2 to the first and second gate drive circuits 301 and 302, respectively, as shown in FIG. 1. In an alternative exemplary embodiment, the first and second integrated chips 200_1 and 200_2 may be connected to the first and second gate drive circuits 301 and 302, respectively.

The first gate drive circuit 301 outputs odd-numbered gate signals in response to the first gate control signal GCS1. The odd-numbered gate signals are applied to the odd-numbered gate lines in sequence. The second gate drive circuit 302 outputs even-numbered gate signals in response to the second gate control signal GCS2. The even-numbered gate signals are applied to the even-numbered gate lines in sequence. Accordingly, the first and second drive circuits 301 and 302 may alternately output the gate signals.

In an exemplary embodiment, as shown in FIG. 1, the two integrated chips 200_1 and 200_2 may be embedded on the display panel 100, but not being limited thereto. In such an embodiment, the number of the integrated chips may be variously modified based on the size or resolution of the display panel 100. In one exemplary embodiment, for example, one or more, or three or more integrated chips may be mounted on the display panel 100. In an exemplary embodiment, as shown in FIG. 1, a structure that the first and second integrated chips 200_1 and 200_2 may be directly embedded on the display panel 100, but not being limited thereto. In an alternative exemplary embodiment, the first and second integrated chips 200_1 and 200_2 may be embedded on a flexible circuit film (not shown) attached to the display panel 100. In such an embodiment, signals output from the first and second integrated chips 200_1 and 200_2 may be applied to the display panel 100 through the flexible circuit film.

In an exemplary embodiment, as shown in FIG. 1, the two gate drive circuit 301 and 302 are disposed within the display panel 100, but not being limited hereto. In an alternative exemplary embodiment, the number and position of the gate drive circuits in the display panel 100 may be modified in variety.

Figure 2:
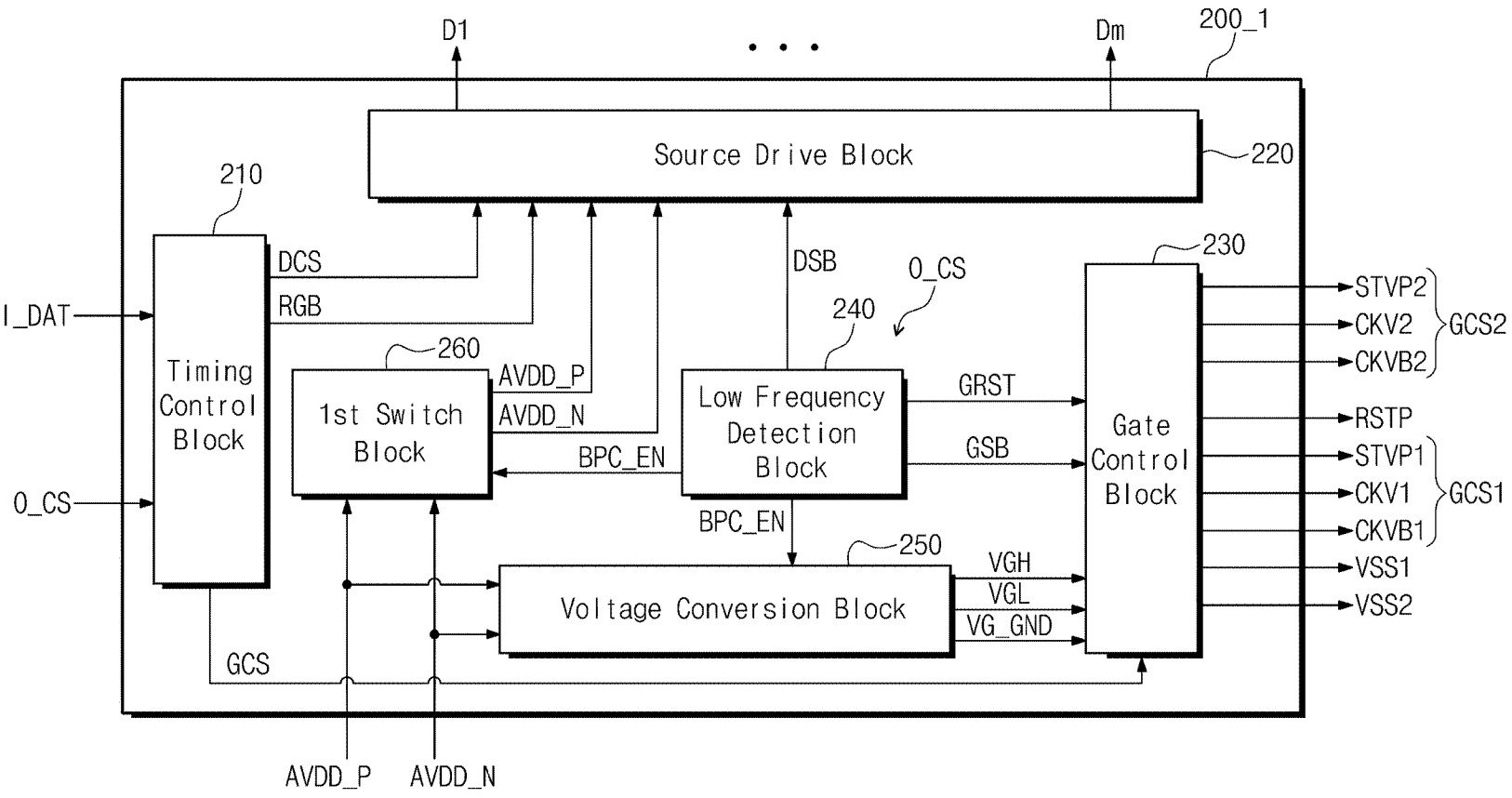
FIG. 2 is a block diagram illustrating an exemplary embodiment of a first integrated chip shown in FIG. 2.
Figure 3:
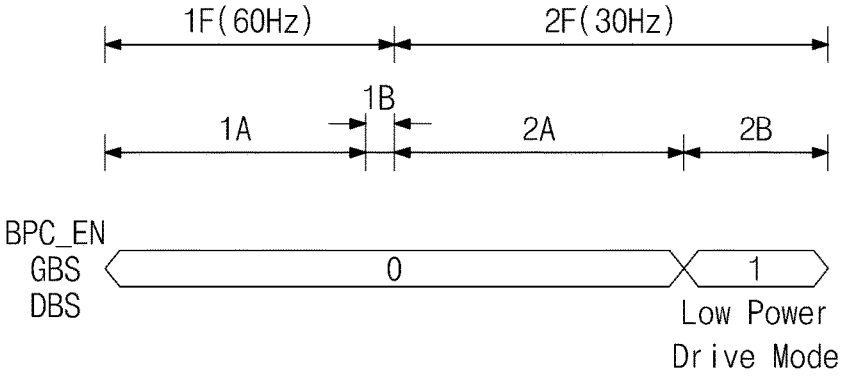
FIG. 3 illustrates frame periods of a normal drive mode and a low frequency drive mode in an exemplary embodiment of a display apparatus according to the invention.

FIG. 2 is a block diagram illustrating an exemplary embodiment of the first integrated chip 200_1 shown in FIG. 2, and FIG. 3 illustrates frame periods of a normal drive mode and a low frequency drive mode in an exemplary embodiment of a display apparatus according to the invention. In such an embodiment, the first integrated chip 200_1 is substantially the same as the second integrated chip 200_2. Accordingly, the first integrated chip 200_1 will be hereinafter described in detail with reference to FIG. 2, and any repetitive detailed description of the second integrated chip 200_2 will hereinafter be omitted.

Referring to FIG. 2, an exemplary embodiment of the first integrated chip 200_1 includes a timing control block 210, a source drive block 220, a gate control block 230, a low frequency detection block 240, a voltage conversion block 250, and a first switch block 260. In an alternative exemplary embodiment, the timing control block 210 or the source drive block 220 may be disposed outside of the first integrated chip 200_1.

The timing control block 210 receives external control signals O_CS and external image data I_DAT from an external system (nor shown), and outputs a gate-side control signal GCS, a data control signal DCS and image data RGB. The source drive block 220 receives the data control signal DCS and the image data RGB from the timing control block 210, and outputs the data signals, e.g., first to m-th data signals D1 to Dm. In such an embodiment, the data control signals DCS and the image data RGB may be transferred from a timing control block of the second integrated chip 200_2 toward a source drive block of the second integrated chip 200_2.

The source drive block 220 receives the data control signal DCS and the image data RGB from the timing control block 210, converts the image data RGB into data voltages, and supplies the data voltages to the data lines DL1 to DL2*m* of the display panel 100 based on the data control signal DCS.

The gate control block 230 outputs the first and second gate control signals GCS1 and GCS2 based on the gate-side control signal GCS supplied from the timing control block 210.

The gate control block 230 converts the gate-side control signal GCS, which is received from the timing control block 210, into the first and second gate control signals GCS1 and GCS2 for driving or activating the first and second gate drive circuits 301 and 302. The first gate control signal GCS1 may include a first vertical start signal STVP1, and first and second clock signals CKV1 and CKVB1, and the second gate control signal GCS2 may include a second vertical start signal STVP2, and third and fourth clock signals CKV2 and CKVB2. The first and second clock signals CKV1 and CKVB1 may be different in phase from each other (e.g., reversed from each other), and the third and fourth clock signals CKV2 and CKVB2 may be different in phase each other. In such an embodiment, the first and third clock signals CKV1 and CKV2 may be different in phase from each other, and the second and fourth clock signals CKVB1 and CKVB2 may be different in phase from each other.

The voltage conversion block 250 receives first and second drive voltages AVDD_P and AVDD_N from an external system. The first and second drive voltages AVDD_P and AVDD_N may have positive and negative polarities, respectively, with respect to a reference voltage. The voltage conversion block 250 changes the first and second drive voltages AVDD_P and AVDD_N into a high gate voltage VGH and a low gate voltage VGL. The high and low gate voltages VGH and VGL are transferred to the gate control block 230. The gate control block 230 may define the high and low levels of the first and second gate control signals GCS1 and GCS2 based on the high and low gate voltages VGH and VGL.

The high gate voltage VGH has a positive polarity with respect to the reference voltage. The low gate voltage VGL has a negative polarity with respect to the reference voltage. The voltage conversion block 250 further supplies a ground gate voltage VG_GND to the gate control block 230. In one exemplary embodiment, for example, the ground gate voltage VG_GND may be substantially the same as the reference voltage.

The low frequency detection block 240 receives the external control signals O_CS, e.g., a part of signals included therein, from an external system, and outputs a power control signal, e.g., first to third power control signals BPC_EN, DSB and GSB, for controlling a power mode. The power mode may include a normal drive mode where images are displayed with a frequency higher than a predetermined reference frequency, e.g., 60 hertz (Hz), and a low frequency drive mode where images are displaying with a frequency lower than the reference frequency. In one exemplary embodiment, for example, the display apparatus 400 may operate in the low frequency drive mode when displaying a still image.

Referring to FIG. 3, in an exemplary embodiment, when images are displayed with 60 Hz in the normal drive mode, a period of one second is divided into first frame periods 1F, that is, 60 first frame periods 1F. Each of the first frame periods 1F may be substantially divided into a first active period 1A during which the data voltage is output from the source drive block 220 (shown in FIG. 2), and a first blank period 1B during which the data voltage is not output.

In the low frequency drive mode, the display panel 100 operates with a frequency lower than 60 Hz. In one exemplary embodiment, for example, images may be displayed with 30 Hz in the low frequency drive mode, the one second period is divided into second frame periods 2F, e.g., 30 second frame periods 2F. In such an embodiment, each width of the second frame periods 2F is longer than each width of the first frame periods 1F. In such an embodiment, the second frame period 2F may be substantially divided into a second active period 2A during which the data voltage is output from the source drive block 220, and a second blank period 2B during which the data voltage is not output from the source drive block 220.

In an exemplary embodiment, the display apparatus 400 may operate in the low frequency drive mode during the second blank period 2B such that the data voltage is not applied to the data lines.

In an exemplary embodiment, during the first active period 1A and the first blank period 1B in the normal drive mode, and during the second active period 2A in the low frequency drive mode, the first to third power control signals BPC_EN, DSB and GSB may be in a first state (0). In such an embodiment, the first to third power control signals BPC_EN, DSB and GSB are in a second state (1) during the second blank period 2B, such that the display apparatus 400 may operate in the low power drive mode.

In an exemplary embodiment, the display apparatus 400 consumes less power in the second blank period 2B than the first and second active periods 1A and 2A by operating the display apparatus 400 in the low power drive mode during the second blank period 2B.

In an exemplary embodiment, as shown in FIG. 3, the second blank period 2B substantially the same as a low power drive period, during which the display apparatus is operating in the low power drive mode, that is, has substantially the same temporal width as the low power drive period, not being limited thereto. In an alternative exemplary embodiment, the temporal width of the low power drive period may be less than the temporal width of the second blank period 2B, and may be within the second blank period 2B.

In an exemplary embodiment, the low power drive mode may include a standby mode and a power-off mode. The standby mode is a mode in which power consumption is reduced by lessening bias currents applied to one or more circuits, and the power-off mode is a mode in which power consumption is reduced by turning off a circuit included in the blocks. The standby mode and the power-off mode will be described in greater detail later in conjunction with the drawings.

The low frequency detection block 240 compares a drive frequency, based on which the display panel 100 operates, with the reference frequency, and then determines states of the first to third power control signals BPC_EN, DSB and GSB based on a result of the comparison. In one exemplary embodiment, for example, the first to third power control signals BPC_EN, DSB and GSB are each composed of one bit, and the first to third power control signals BPC_EN, DSB and GSB may be set as '0' in the first state and may be set as '1' in the second state.

The first power control signal BPC_EN is applied to the first switch block 260 and the voltage conversion block 250, the second power control signal DSB is applied to the source drive block 220, and the third power control signal GSB is applied to the gate control block 230.

The first switch block 260 receives first and second drive voltages AVDD_P and AVDD_N from an external system. The first drive voltage AVDD_P may have a positive polarity with respect to the reference voltage, and the second drive voltage AVDD_N may have a negative polarity with respect to the reference voltage. The first and second drive voltages AVDD_P and AVDD_N may be selectively applied (e.g., supplied or interrupted) to the source drive block 220 based on the state of the first power control signal BPC_EN. When the first power control signal BPC_EN is in the first state, the first switch block 260 supplies the first and second drive voltages AVDD_P and AVDD_N to the source drive block 220. When the first power control signal BPC_EN is in the second state, the first switch block 260 interrupts the supply of the first and second drive voltages AVDD_P and AVDD_N to the source drive block 220.

In such an embodiment, one or more circuits of internal circuits of the source drive block 220 may be disabled by the interruption to the first and second drive voltages AVDD_P and AVDD_N in the low power drive mode. Therefore, in such an embodiment, power consumption may be effectively reduced by the power-off mode that stops activations of one or more blocks (or circuits) that do not operate during the low power drive period.

The first power control signal BPC_EN output from the low frequency detection block 240 is applied to the voltage conversion block 250. The first power control signal BPC_EN may interrupt an output of the high gate voltage VGH from the voltage conversion block 250, based on the state thereof.

The second power control signal DSB is applied to the source drive block 220, and the third power control signal GSB is applied to the gate control block 230. Operations of the source drive block 220 and the gate control block 230, in response to the second and third power control signals DSB and GSB, will be detailed later in greater detail with reference to FIGS. 3 and 4.

Figure 4:
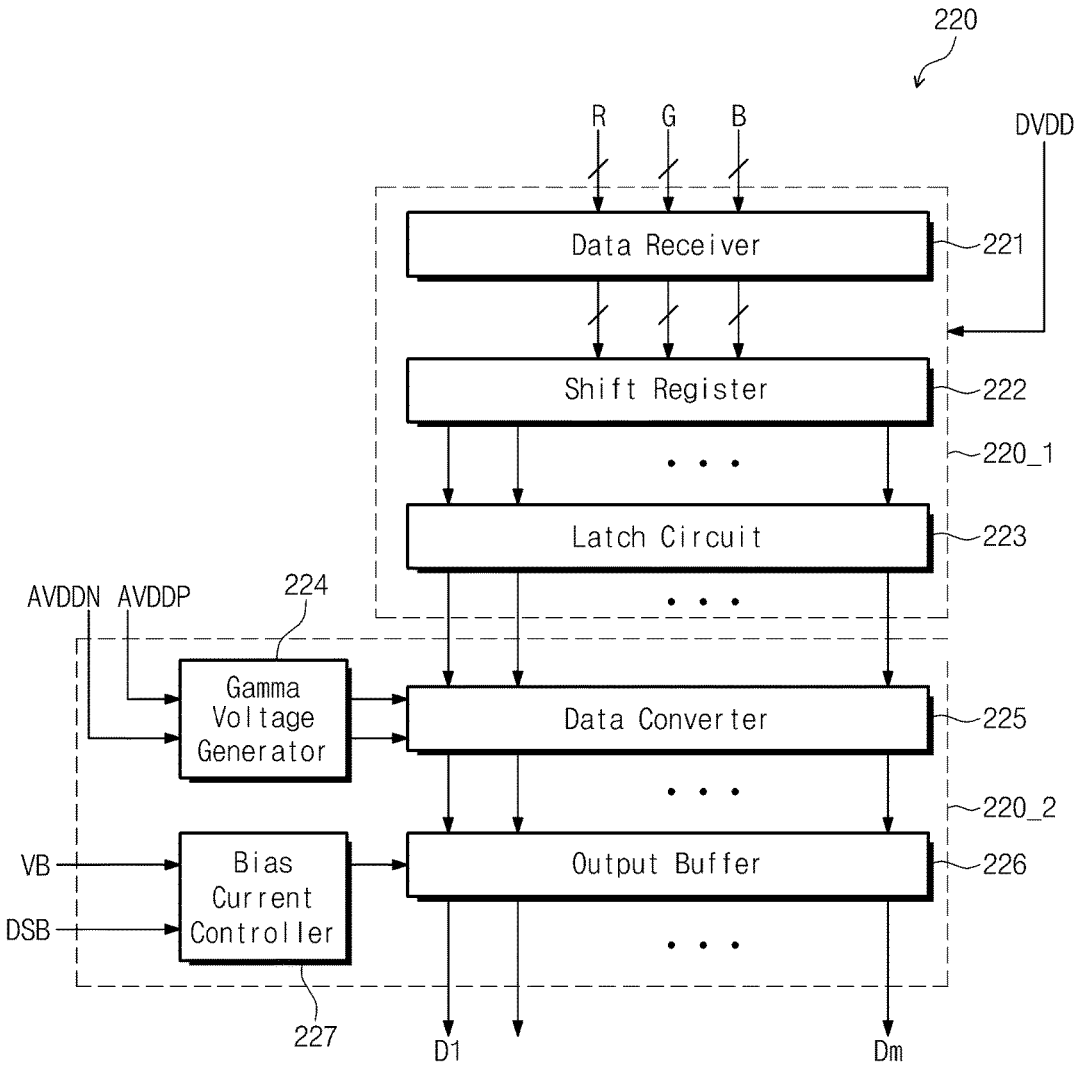
FIG. 4 is an internal block diagram illustrating an exemplary embodiment of the source drive block shown in FIG. 2.

FIG. 4 is an internal block diagram illustrating an exemplary embodiment of the source drive block 220 shown in FIG. 2.

Referring to FIG. 4, in an exemplary embodiment, the source drive block 220 includes a digital processing block 220_1 and an analog processing block 220_2. The digital processing block 220_1 includes a data receiver 221, a shift register 222 and a latch circuit 223. The digital processing block 220_1 may receive a separate power source voltage DVDD. The analog processing block 220_2 includes a gamma voltage generator 224, a data converter 225, an output buffer 226 and a bias current controller 227.

The data receiver 221 receives the image data RGB from the timing control block 210 (shown in FIG. 2), converts the image data RGB into a format adaptable to the source drive block 220, and supplies the converted image data to the shift register 222. The shift register 222 aligns the converted image data, which are supplied form the data receiver 221, into image data for one line (e.g., image data for pixels in a same row) in response to the data control signal DCS applied from the timing control block 210.

The latch circuit 223 stores the image data of one line which are supplied from the shift register 222.

The gamma voltage generator 224 receives the first and second drive voltages AVDD_P and AVDD_N from the first switch block 260 and generates a plurality of gamma voltages. The gamma voltages may include positive gamma voltages and negative gamma voltages. In an exemplary embodiment, the gamma voltage generator 224 may include a positive gamma voltage generator (not shown) and a negative gamma voltage generator (not shown). The positive gamma voltage generator receives the first drive voltage AVDD_P to generate the positive gamma voltages, and the negative gamma voltage generator receives the second drive voltage AVDD_N to generate the negative gamma voltages. In an exemplary embodiment, the gamma voltage generator 224 may further receive gamma reference voltages. Each gamma reference voltage may have one of voltage levels positioned between voltage levels of the first and second drive voltages AVDD_P and AVDD_N.

The data converter 225 receives the image data of one line from the latch circuit 223 to convert the image data into data voltages of one line based on the gamma voltages.

The data voltages are supplied to the display panel 100 through the output buffer 226. The output buffer 226 stores the data voltages for a predetermined time and outputs the stored data voltages simultaneously (e.g., substantially at the same time) to the display panel 100. In such an embodiment, the bias current controller 227 may receive a bias voltage VB from an external system, and control a bias current by adjusting a level of the bias voltage VB based on the second power control signal DSB.

In an exemplary embodiment of the invention, the second power control signal DSB may be in the second state during the low power drive period, and in the first state during the rest period. Therefore, in such an embodiment, power consumption may be substantially reduced in the standby mode by lessening the bias current of the output buffer 225 during the low power drive period.

Figure 5:
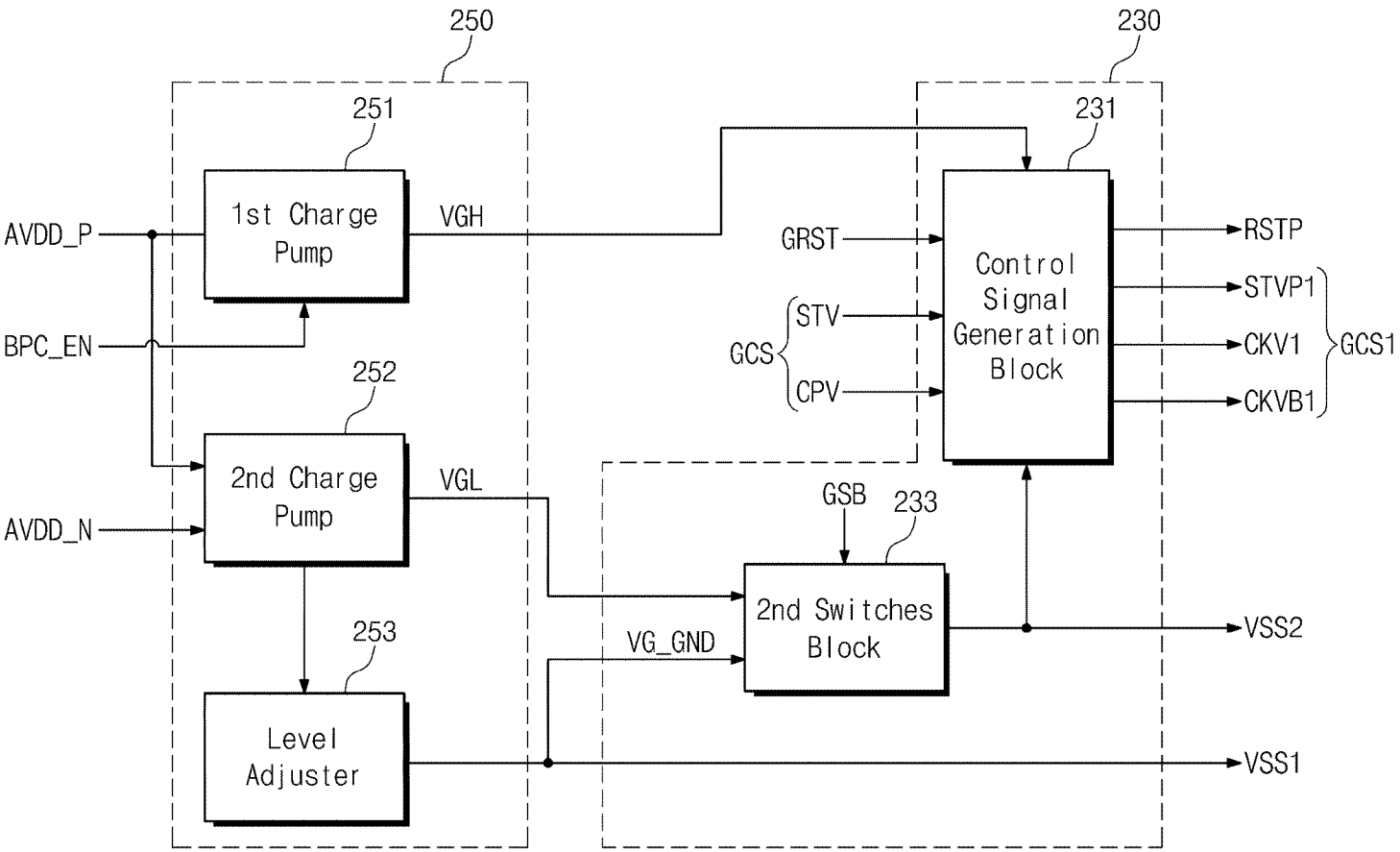
FIG. 5 is an internal block diagram illustrating an exemplary embodiment of the voltage conversion block and the gate control block shown in FIG. 2.

FIG. 5 illustrates an exemplary embodiment of the voltage conversion block 250 and the gate control block 230 shown in FIG. 2.

Referring to FIGS. 2 and 5, the voltage conversion block 250 includes a first charge pump 251, a second charge pump 252 and a level adjuster 253. The first charge pump 251 receives the first drive voltage AVDD_P to generate the high gate voltage VGH, and the second charge pump 252 receives the second drive voltage AVDD_N to generate the low gate voltage VGL. The level adjuster 253 receives the low gate voltage VGL to convert the low gate voltage VGL into the ground gate voltage VG_GND. The ground gate voltage VG_GND may have a voltage level substantially the same as the reference voltage (e.g. zero volt).

The first charge pump 251 receives the first power control signal BPC_EN from the low frequency detection block 240. The first power control signal BPC_EN may control the first charge pump 251 to be turned off during the low power drive period, or allow the high gate voltage VGH to be down to the ground gate voltage VG_GND.

The gate control block 230 includes a control signal generation block 231 and a second switch block 233. The control signal generation block 231 receives the gate-side control signal GCS from the timing control block 210. The gate-side control signal GCS includes an internal vertical start signal STV and an internal clock signal CPV. The second switch block 233 receives the low gate voltage VGL and the ground gate voltage VG_GND from the second charge pump 252 and the level adjuster 253, respectively. The second switch block 233 receives the third power control signal GSB from the low frequency detection block 240.

The third power control signal GSB is maintained in the first state during the first active period 1A and the first blank period 1B of the normal drive mode, and during the second active period 2A of the low frequency drive mode, and maintained in the second state during the low power drive period 2B. When the third power control signal GSB is in the first state, the second switch block 233 selects the low gate voltage VGL from the low gate voltage VGL and the ground gate voltage VG_GND, and supplies the selected low gate voltage VGL to the control signal generation block 231. When the third power control signal GSB is in the second state, the second switch block 233 selects the ground gate voltage VG_GND from the low gate voltage VGL and the ground gate voltage VG_GND, and supplies the selected ground gate voltage VG_GND to the control signal generation block 231.

The control signal generation block 231 receives the internal vertical start signal STV and the internal clock signal CPV from the timing controller 210, and receives an internal reset signal GRST from the low frequency detection block 240. The control signal generation block 231 converts the internal reset signal GRST, the internal vertical start signal STV and the internal clock signal CPV into a reset signal RSTP, a first vertical start signal STVP1, and first and second clock signals CKV1 and CKVB1 based on the high and low gate voltages VGH and VGL, and supplies the converted signals to the first gate drive circuit 301.

For convenience of description, t the control signal generation block 231 of the first integrated chip 200_1 that generates the first gate control signal GCS1 to be supplied to the first gate drive circuit 301 has been described with reference to FIG. 5, but of the second integrated chip 200_2 may also include the control signal generation block 231 that generates the second gate control signal GCS2 to be supplied to the second gate drive circuit 302.

While the third power control signal GSB is maintained in the first state, each of the reset signal RSTP and the first gate control signal GCS1 has a high level, corresponding to the high gate voltage VGH, in the high period, and has a low level, corresponding to the low gate voltage VGL, in the low period.

During the low power drive period during which the third power control signal GSB is maintained in the second state, the second switch block 233 supplies the ground gate voltage VG_GND to the control signal generation block 231 instead of the low gate voltage VGL. Accordingly, when the third power control signal GSB is in the second state, each of the reset signal RSTP and the first gate control signal GCS1 has a high level, corresponding to the high gate voltage VGH, in the high period, and has a low level, corresponding to the ground gate voltage VG_GND, in the low period.

In such an embodiment, while the third power control signal GSB is maintained in the first state, the ground gate voltage VG_GND and the low gate voltage VGL are applied respectively to the first and second voltage nodes VSS1 and VSS2 of the first and second gate drive circuits 301 and 302. Otherwise, during the low power drive period during which the third power control signal GSB is maintained in the second state, the ground gate voltage VG_GND is applied all to the first and second voltage nodes VSS1 and VSS2 of the first and second gate drive circuits 301 and 302, thereby effectively reducing power consumption through the first and second gate drive circuits 301 and 302.

Figure 6:
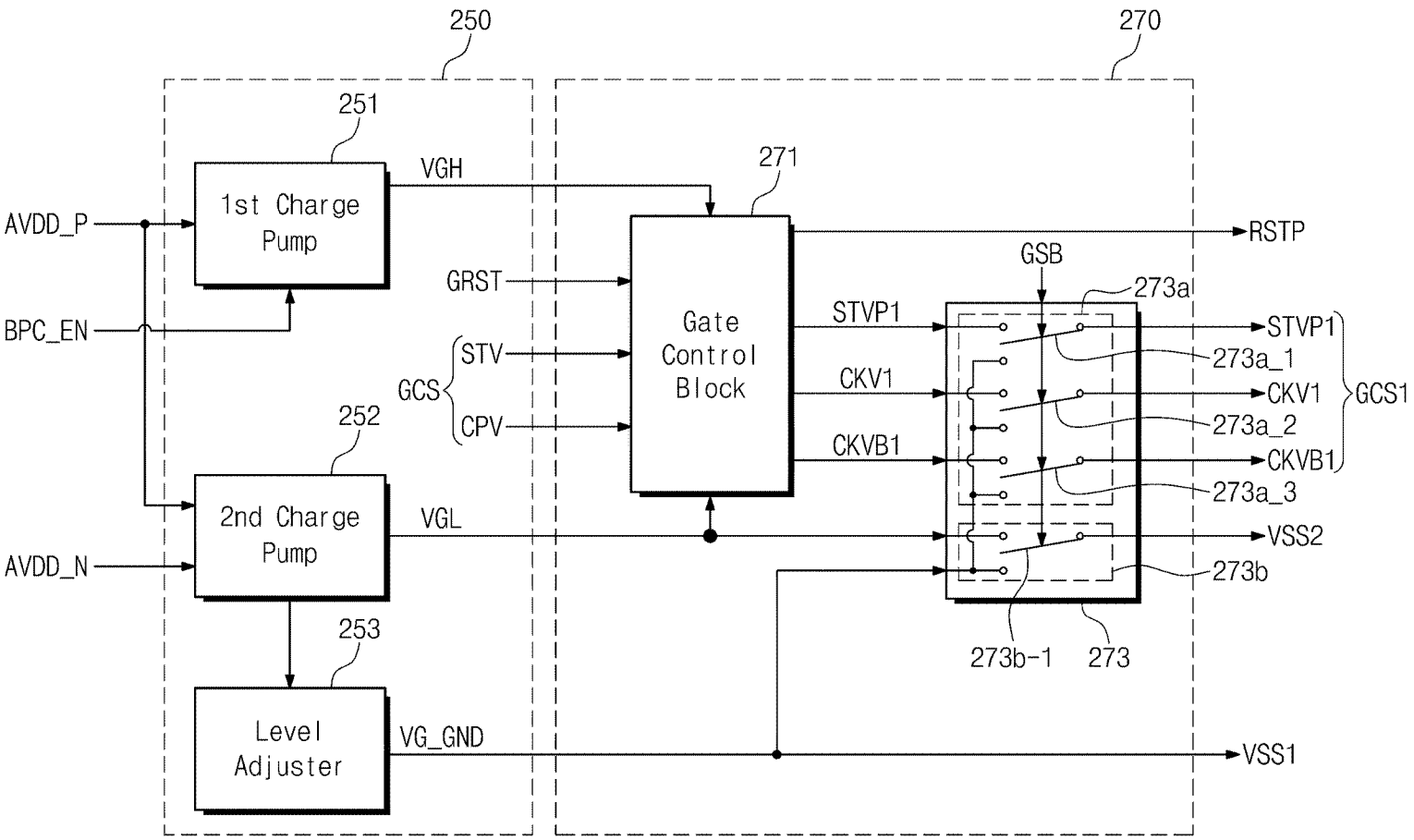
FIG. 6 is an internal block diagram illustrating an alternative exemplary embodiment of a voltage conversion block and a gate control block, according to the invention.

FIG. 6 is an internal block diagram illustrating an alternative embodiment of the voltage conversion block and the gate control block, according to the invention. The same or like elements shown in FIG. 6 have been labeled with the same reference characters as used above to describe the exemplary embodiments of the voltage conversion block and the gate control block shown in FIG. 5, and any repetitive detailed description thereof will hereinafter be omitted or simplified.

Referring to FIG. 6, in an alternative exemplary embodiment, a gate control block 270 includes a control signal generation block 271 and a second switch block 273. The control signal generation block 271 receives a gate-side control signal GCS from the timing control block 210 and an internal reset signal GRST from the low frequency detection block 240. The gate-side control signal GCS includes an internal vertical start signal STV and an internal clock signal CPV.

In such an embodiment, the control signal generation block 271 receives the high gate voltage VGH from the first charge pump 251 and the low gate voltage VGL from the second charge pump 252. The control signal generation block 271 converts the internal reset signal GRST, the internal vertical start signal STV and the internal clock signal CPV into a reset signal RSTP, a first vertical start signal STVP, and first and second clock signals CKV1 and CKVB1 based on the high and low gate voltages VGH and VGL.

In such an embodiment, the second switch block 273 includes a first selector 273*a* and a second selector 273*b*. The first selector 273*a* receives the vertical start signal STVP, and the first and second clock signals CKV1 and CKVB1 from the control signal generation block 271, and the second selector 273*b* receives the low gate voltage VGL and the ground gate voltage VG_GND from the second charge pump 252 and the level adjuster 253, respectively. The first selector 273*a* may further receive the ground gate voltage VG_GND from the level adjuster 253.

In such an embodiment, the second switch block 273 controls operations of the first and second selectors 273*a* and 273*b* in response to the third power control signal GSB which is applied from the low frequency detection block 240. In such an embodiment, the first selector 273*a* may include a first switch 273*a*_1 for switching between the first vertical start signal STVP1 and the ground gate voltage VG_GND in response to the third power control signal GSB, a second switch 273*a*_2 for switching between the first clock signal CKV1 and the ground gate voltage VG_GND, and a third switch 273*a*_3 for switching between the second clock signal CKVB1 and the ground gate voltage VG_GND.

In a period during which the third power control signal GSB is maintained in the first state, the first switch 273*a*_1 outputs the first vertical start signal STVP1, the second switch 273*a*_2 outputs the first clock signal CKV1, and the third switch 273*a*_3 outputs the second clock signal CKVB1. In a low power drive period during which the third power control signal GSB is maintained in the second state, the first to third switches 273*a*_1 to 273*a*_3 output the ground gate voltage VG_GND instead of the first vertical start signal STVP1, the first clock signal CKV1 and the second clock signal CKVB1. Therefore, in such an embodiment, the first clock signal CKV1 and the second clock signal CKVB1, which are applied to the first gate drive circuits 301, may be set to be in the level of the ground gate voltage VG_GND during the low power drive period, the first vertical start signal STVP1. In such an embodiment, the first selector 273*a* may hold the first gate control signal GCS1 at the level of the ground gate voltage VG_GND during the low power drive period.

In an exemplary embodiment, the first selector 273*a* may further include switches (not shown) for holding the second gate control signal GCS2, i.e. the second vertical start signal STVP2, the third clock signal CKV2 and the fourth clock signal CKVB2, which are supplied to the second gate drive circuit 302 during the low power drive period, on the ground gate voltage VG_GND.

The second selector 273*b* may include a fourth switch 273*b*_1 for switching the low gate voltage VGL and the ground gate voltage VG_GND in response to the second power control signal GSB which is applied from the low frequency detection block 240. In a period during which the second power control signal GSB is maintained in the first state, the fourth switch 273*b*_1 outputs the low gate voltage VGL to the second voltage node VSS2. In the low power drive period during which the second power control signal GSB is maintained in the second state, the fourth switch 273*b*_1 outputs the ground gate voltage VG_GND to the second voltage node VSS2.

Accordingly, in the low power drive period, operation with the first and second gate drive circuits 301 and 302 is not performed, such that power consumption is substantially reduced in the first and second gate drive circuits 301 and 302.

Figure 7:
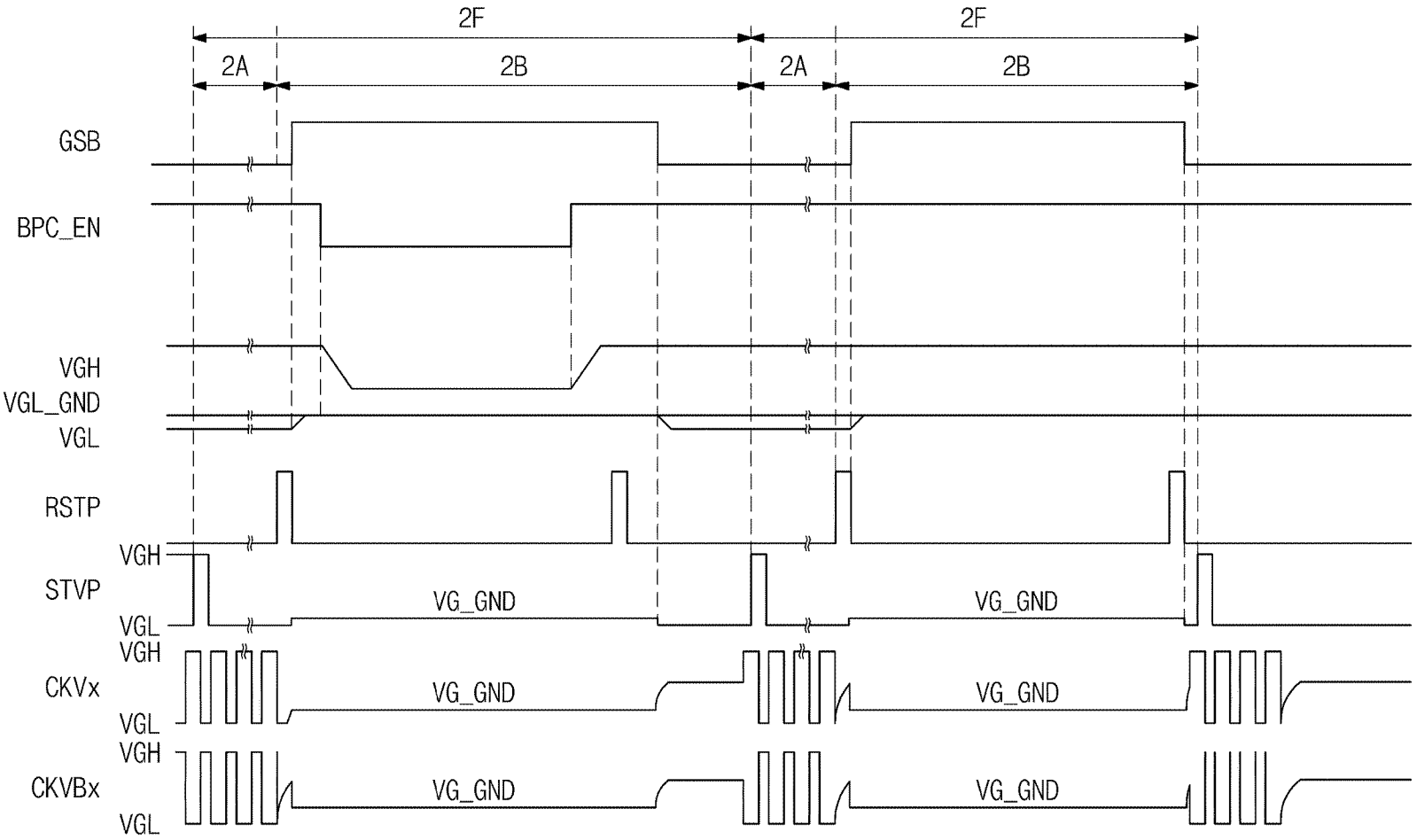
FIG. 7 is a waveform diagram showing an exemplary embodiment of the signals shown in FIG. 6.

FIG. 7 is a waveform diagram showing an exemplary embodiment of the signals shown in FIG. 6.

Referring to FIGS. 6 and 7, each of the second frame periods 2F of the low frequency drive mode includes the second active period 2A and the second blank period 2B. For convenience of illustration, FIG. 7 reductively shows without a part of the second active period 2A, focusing on the second blank period 2B. However, it would be understood that the second active period 2A may be substantially longer than the second blank period 2B.

During the second active period 2A, the first vertical start signal STVP1, the first clock signal CKV1 and the second clock signal CKVB1 have regular or normal waveforms. In an exemplary embodiment, the first vertical start signal STVP1, as a signal for starting the first gate drive circuit 301, is enabled to be a high state at the beginning of the second active period 2A. The first vertical start signal STVP1 has a level corresponding to the high gate voltage VGH during the high period, and has a level corresponding to the low gate voltage VGL during the low period.

The first and second clock signals CKV1 and CKVB1 may be inverted signals of each other. The first and second clock signals CKV1 and CKVB1 have levels corresponding to the high gate voltage VGH during the high period thereof, and have levels corresponding to the low gate voltage VGL during the low period thereof.

The reset signal RSTP is for resetting the first and second gate drive circuits 301 and 302. The reset signal RSTP may reset the first and second gate drive circuits 301 and 302 at a predetermined time during the second blank period 2B, e.g., after the beginning and before the end of the second blank period 2B. However, the reset point and times the first and second gate drive circuits 301 and 302 by the reset signal RSTP may not be limited to those shown in FIG. 7.

During the second blank period 2B, at least one of the signals changes the state thereof. In one exemplary embodiment, for example, the first power control signal BPC_EN and the third power control signal GSB change the states thereof during the second blank period 2B, as in the second blank period 2B at the left side of FIG. 7. In such an embodiment, when the left second blank period 2B begins, the first power control signal BPC_EN changes to a low state from a high state while the third power control signal GSB changes to a high state from a low state. When the first power control signal BPC_EN is in the low state, the power-off mode is enabled. In the power-off mode, the high gate voltage VGH goes down to the ground gate voltage VG_GND. When the third power control signal GSB is in the high state, the standby mode is enabled. In the standby mode, the first vertical start signal STVP1 and the first and second clock signals CKV1 and CKVB1 are maintained at the ground gate voltage VG_GND. In the standby mode, the low gate voltage VGL may be maintained at the ground gate voltage VG_GND. Accordingly, both of the power-off mode and the standby mode may be enabled during the second blank period 2B.

In such an embodiment, the first power control signal BPC_EN may stay in the high state, without changed to the low state during the second blank period 2B, e.g., the second black period 2B at the right side of FIG. 7. During such a second blank period 2B, where the power-off mode is disabled, the high gate voltage VGH does not go down to the ground gate voltage VG_GND, and the third power control signal GSB changes to a high state from a low state. When the third power control signal GSB is in the high state, the standby mode is enabled. Accordingly, the standby mode is enabled such that the first vertical start signal STVP1, the first clock signal CKV1 and the second clock signal CKVB1 are maintained at the ground gate voltage VG_GND, and the low gate voltage VGL is also maintained at the ground gate voltage VG_GND. Accordingly, the power-off mode may be disabled during the second blank period 2B, while the standby mode is enabled.

In an exemplary embodiment, the display apparatus 400 operate in one of the power-off mode and the standby mode, or in all of the two modes, such a low power drive mode may be determined based on a drive frequency of the display apparatus 400.

Figure 8:
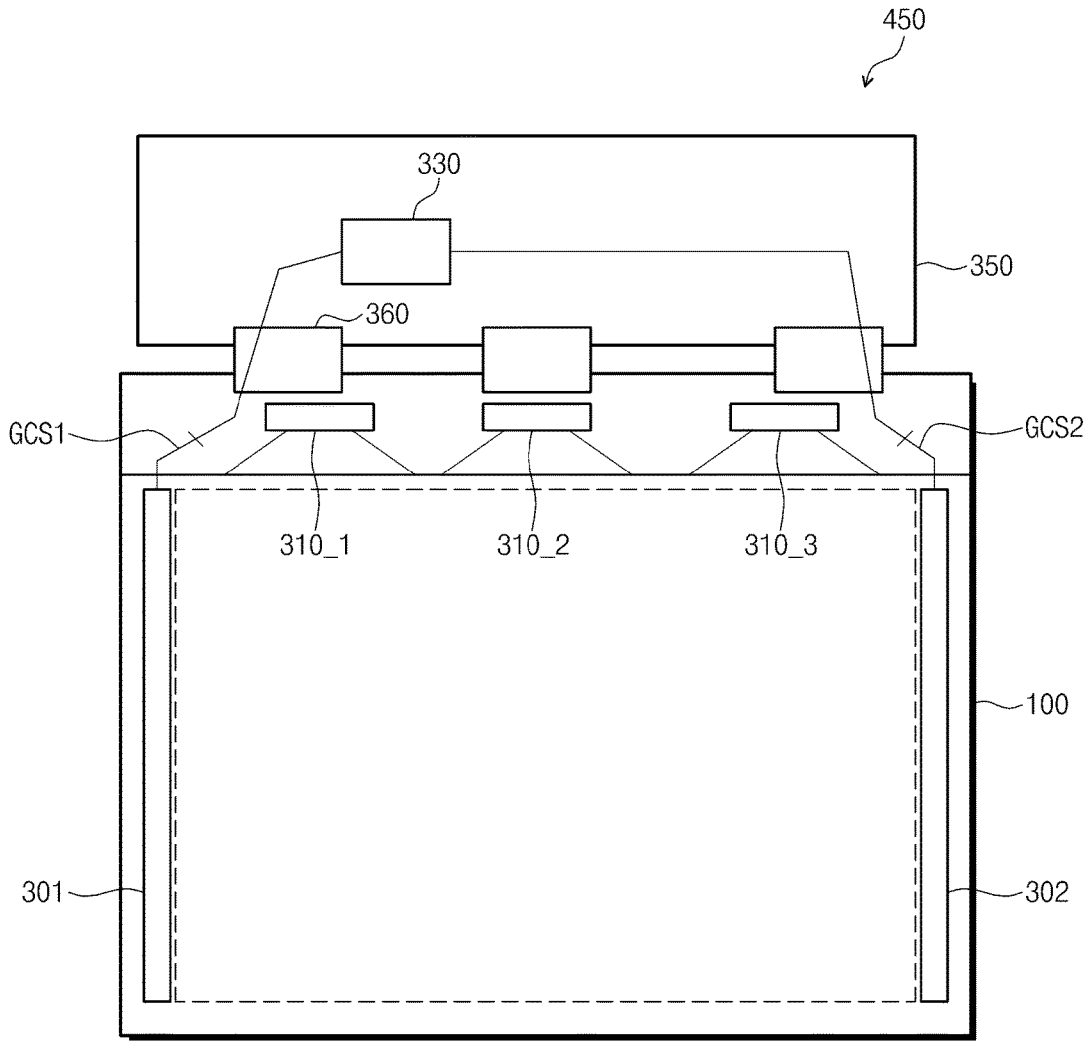
FIG. 8 is a schematic plan view of an alternative exemplary embodiment of a display apparatus according to the invention.
Figure 9:
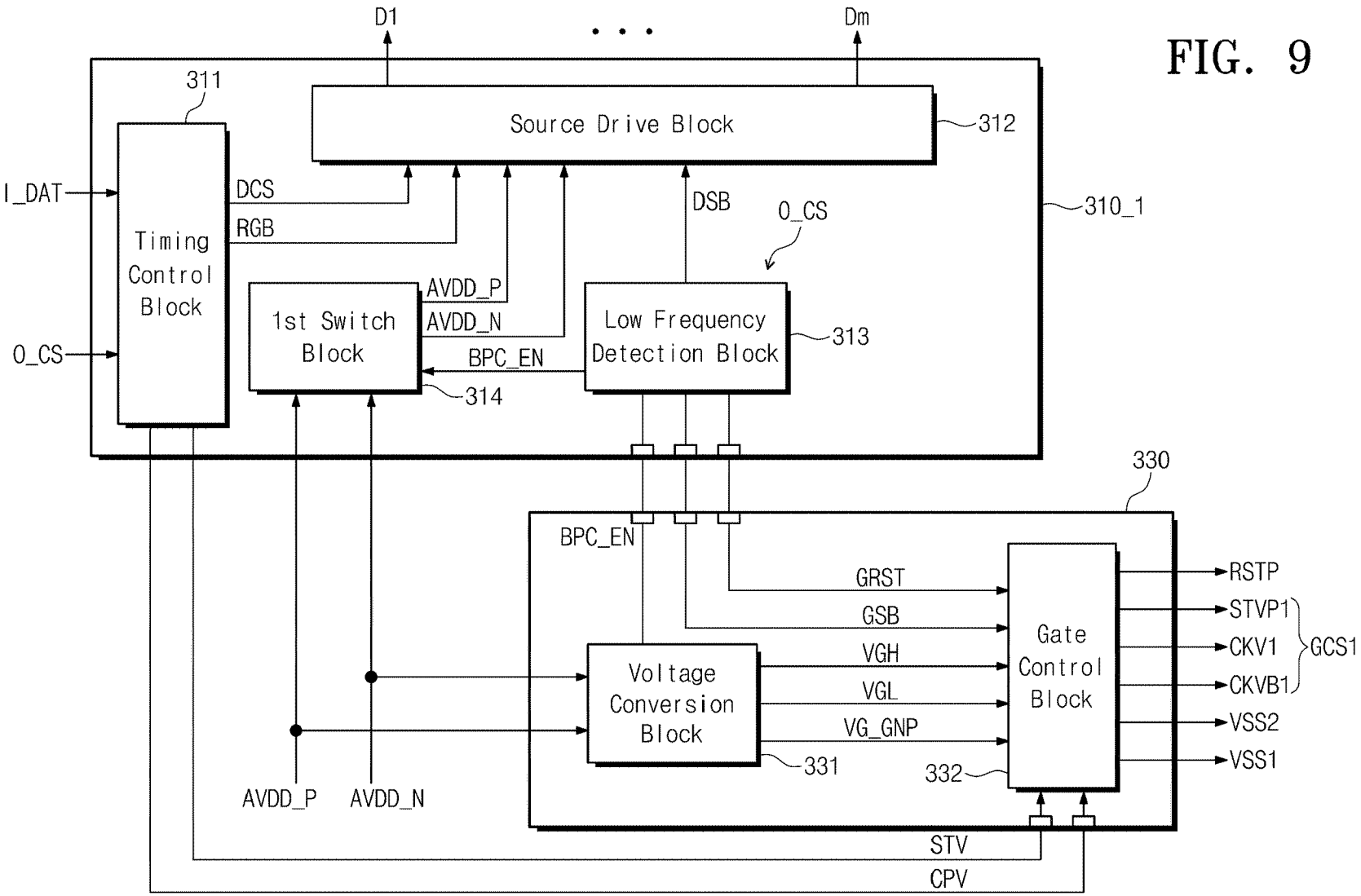
FIG. 9 is an internal block diagram of an exemplary embodiment of the first integrated chip and the drive chip shown in FIG. 8.

FIG. 8 is a schematic plan view of an alternative exemplary embodiment of a display apparatus according to the invention, and FIG. 9 is an internal block diagram of an exemplary embodiment of the first integrated chip and the drive chip shown in FIG. 8.

Referring to FIG. 8, an exemplary embodiment of the display apparatus 450 includes a display panel 100, first and second drive circuits 301 and 302 disposed in a black matrix area BA, and first to third integrated chips 310_1 to 310_3. The display apparatus 450 further includes a printed circuit board ("PCB") 350 adjacent to the display panel 100, and connection films 360 which electrically connects the PCB 350 to the display panel 100.

The display apparatus 450 further includes a drive chip 330 disposed, e.g., mounted, on the PCB 350. The drive chip 330 may be electrically connected to one of the first to third integrated chips 310_1 to 310_3. In an exemplary embodiment, the drive chip 330 is electrically connected to the first integrated chip 310_1, and receives control signals from the first integrated chip 310_1. The drive chip 330 is electrically connected to the first and second gate drive circuits 301 and 302, and supplies first and second gate control signals GCS1 and GCS2 to the first and second gate drive circuits 301 and 302, respectively.

Referring to FIG. 9, the first integrated chip 310_1 includes a timing control block 311, a source drive block 312, a low frequency detection block 313, and a first switch block 314. The timing control block 311, the source drive block 312, the low frequency detection block 313 and the first switch block 314 of the first integrated chip 310_1 is substantially the same as those of the first integrated chip 200_1 shown in FIG. 2, and any repetitive detailed description thereof will be omitted.

The drive chip 330 includes a voltage conversion block 331 and a gate control block 332. In an alternative exemplary embodiment, the voltage conversion block 331 may be disposed outside the drive chip 330. The voltage conversion block 331 receives first and second drive voltages AVDD_P and AVDD_N from an external system. The voltage conversion block 331 converts the first and second drive voltages AVDD_P and AVDD_N into the high and low gate voltages VGH and VGL which are transferred to the gate control block 332. The gate control block 332 may determine high and low levels of the first and second gate control signals GCS1 and GCS2 in response to the high and low gate voltages VGH and VGL. In FIG. 9, the second gate control signal GCS2 is not shown for convenience of illustration.

The low frequency detection block 313 of the first integrated chip 310_1 receives the external control signals O_CS, e.g., a part of the signals included therein, from an external system and outputs first to third power control signals BPC_EN, DSB and GSB for controlling a power mode. The power mode may include a normal drive mode to display images with a predetermined reference frequency (e.g. 60 Hz), and the low frequency drive mode to display images with a frequency lower than the reference frequency. In one exemplary embodiment, for example, the display apparatus 400 may operate in the low frequency drive mode when the display apparatus 400 displays a still image.

The first power control signal BPC_EN is applied to the first switch block 314 and the voltage conversion block 331, the second power control signal DSB is applied to the source drive block 312, and the third power control signal GSB is applied to the gate control block 332.

The first switch block 314 receives first and second drive voltages AVDD_P and AVDD_N from an external system. The first and second drive voltages AVDD_P and AVDD_N may be supplied or interrupted based on a state of the first power control signal BPC_EN. Therefore, one or more circuits of internal driver circuits of the source drive block 312 may be disabled by interrupting transmission of the first and second drive voltages AVDD_P and AVDD_N thereto during the low power drive period. As a result, in such an embodiment, power consumption is substantially reduced through the power-off mode that partly stops operations of a portion of the blocks during the low power drive period.

The first power control signal BPC_EN output from the low frequency detection block 313 is applied to the voltage conversion block 331. In such an embodiment, the high gate voltage VGH may not be output from the voltage conversion block 331 based on the state of the first power control signal BPC_EN.

The gate control block VGH receives a gate-side control signal GCS from the timing control block 311. The gate-side control signal GCS includes an internal vertical start signal STV and an internal clock signal CPV. The gate control block 332 further receives the third power control signal GSB and the internal reset signal GRST from the low frequency detection block 313.

In an exemplary embodiment, the gate control block 332 may determine states of the first and second gate control signals GCS1 and GCS2 based on the state of the third power control signal GSB. In such an embodiment, the first vertical start signal STVP1, the first clock signal CKV1 and the second clock signal CKVB1 may be maintained at the ground gate voltage VG_GND, the low gate voltage VGL may be maintained at the ground gate voltage VG_GND, based on the state of the third power control signal GSB.

Therefore, it is possible to reduce power consumption through the first and second gate drive circuits 301 and 302 in the low power drive period of the low frequency drive mode because there is no need of operating the first and second gate drive circuits 301 and 302 therein.

As described above, in exemplary embodiment of the display apparatus according to the invention, some functional blocks may stop operations thereof or states of control signals may be held at a ground voltage, during a low power operation period, such that the power consumption thereof is effectively and substantially reduced.

While the invention has been described with reference to exemplary embodiments, it will be apparent to those skilled in the art that various changes and modifications may be made without departing from the spirit and scope of the invention. Therefore, it should be understood that the above embodiments are not limiting, but illustrative.

What is claimed is:

1. A display apparatus comprising:

a timing control block which outputs image data based on external image data in response to external control signals, and generates a data control signal and a gate-side control signal based on the external control signal;

a source drive block which converts the image data into a data voltage in response to the data control signal;

a low frequency detection block which receives the external control signal, detects a low power drive period based on the external control signal and generates a power control signal, a state of which is determined based on a result of the detection of the low power drive period;

an integrated chip which receives first and second drive voltages, wherein the integrated chip includes a first switch block which turns off a circuit of the source drive block in response to the power control signal from the low frequency detection block during the low power drive period;

a gate drive circuit which generates a gate signal in response to a gate control signal from the integrated chip; and a display panel which receives the gate signal and the data voltage and displays an image with a frequency higher than a reference frequency in a normal drive mode or with a frequency lower than the reference frequency in a low frequency drive mode, wherein the power control signal is in the normal drive mode during a plurality of first frame periods corresponding to the frequency higher than the reference frequency, the power control signal is in the low frequency drive mode during a plurality of second frame periods corresponding to the frequency lower than the reference frequency, each of the first frame periods includes a first active period during which the data voltage is supplied to the display panel, and a first blank period during which the data voltage is interrupted to the display panel, each of the second frame periods includes a second active period during which the data voltage is supplied to the display panel, and a second blank period during which the data voltage is interrupted to the display panel, the second blank period is longer than the first blank period, and after a beginning and before an end of the second blank period, the gate drive circuit is reset by at least one reset signal.

2. The display apparatus according to claim 1, wherein the integrated chip further comprises:

a voltage conversion block which receives the first and second drive voltages and outputs a high gate voltage, a low gate voltage and a ground gate voltage; and a gate control block which receives the gate-side control signal from the timing control block and receives the high and low gate voltages from the voltage conversion block.

3. The display apparatus according to claim 2, wherein the voltage conversion block comprises:

a first charge pump which converts the first drive voltage into the high gate voltage;

a second charge pump which converts the second drive voltage into the low gate voltage; and a level adjuster which converts the low gate voltage into the ground gate voltage.

4. The display apparatus according to claim 3, wherein the first charge pump receives the power control signal from the low frequency detection block and lowers the high gate voltage to the ground gate voltage based on the state of the power control signal during the low power drive period.

5. The display apparatus according to claim 2, wherein the gate control block comprises:

a control signal generation block which converts the gate-side control signal into the gate control signal, and determines high and low levels of the gate control signal based on the high and low gate voltages from the voltage conversion block; and a second switch block which receives the power control signal and holds the low gate voltage at the ground gate voltage during the low power drive period.

6. The display apparatus according to claim 2, wherein the gate control block comprises:

a control signal generation block which converts the gate-side control signal into the gate control signal, and determines high and low levels of the gate control signal based on the high and low gate voltages from the voltage conversion block; and a second switch block which receives the gate control signal and the low gate signal, and holds the gate control signal and the low gate voltage at the ground gate voltage based on the power control signal from the low frequency detection block during the low power drive period.

7. The display apparatus according to claim 6, wherein the second switch block comprises:

a first selector which holds the gate control signal at the ground gate voltage in response to the power control signal from the low frequency detection block during the low power drive period; and a second selector which holds the low gate voltage at the ground gate voltage in response to the power control signal from the low frequency detection block during the low power drive period.

8. The display apparatus according to claim 2, wherein the integrated chip is provided in plural, wherein one of the integrated chips includes the gate control block.

9. The display apparatus according to claim 1, further comprising:

a voltage conversion block which receives the first and second drive voltages and outputs a high gate voltage, a low gate voltage and a ground gate voltage based on the first and second drive voltages; and a drive chip including a gate control block which receives the gate-side control signal from the timing control block and receives the high and low gate voltages from the voltage conversion block.

10. The display apparatus according to claim 9, further comprising:

a printed circuit board on which the drive chip is mounted; and a connection film which electrically connects the printed circuit board with the display panel.

11. The display apparatus according to claim 9, wherein the integrated chip is provided in plural, wherein one of the integrated chips is electrically connected to the drive chip.

12. The display apparatus according to claim 9, wherein the voltage conversion block is included in the drive chip.

13. The display apparatus according to claim 1, wherein the source drive block comprises:

a data converter which converts the image data into data voltages of one line;

an output buffer which stores the data voltages for a predetermined time and outputs the data voltages simultaneously to the display panel; and a bias current controller which receives the power control signal from the low frequency detection block and controls a bias current that is to be supplied to the output buffer.

14. The display apparatus according to claim 1, wherein the low power drive period is in the second blank period of each of the second frame periods.

15. The display apparatus according to claim 1, wherein the timing control block is included in the integrated chip.

16. The display apparatus according to claim 1, wherein the source drive block is included in the integrated chip.

* * * * *